US006761852B2

(12) United States Patent
Yeo et al.

(10) Patent No.: US 6,761,852 B2
(45) Date of Patent: Jul. 13, 2004

(54) FORMING COMPLEX-SHAPED ALUMINUM COMPONENTS

(75) Inventors: Chee-Tian Yeo, Singapore (SG); Lye-King Tan, Singapore (SG)

(73) Assignee: Advanced Materials Technologies Pte. Ltd., Singapore (SG)

( * ) Notice: Subject to any disclaimer, the term of this patent is extended or adjusted under 35 U.S.C. 154(b) by 0 days.

(21) Appl. No.: 10/095,272

(22) Filed: Mar. 11, 2002

(65) Prior Publication Data

US 2003/0170137 A1 Sep. 11, 2003

(51) Int. Cl.[7] ..... B22F 3/22; C22C 1/04
(52) U.S. Cl. ..... 419/37; 419/46; 419/54
(58) Field of Search ..... 419/37, 46, 54, 419/10, 14, 36

(56) References Cited

U.S. PATENT DOCUMENTS 3,971,657 A * 7/1976 Daver ..... 75/211
4,623,388 A 11/1986 Jatkar et al. ..... 75/232
4,973,522 A 11/1990 Jordan et al. ..... 428/614
5,057,903 A 10/1991 Olla ..... 357/72
6,077,327 A 6/2000 Hamayoshi et al. ..... 75/332
6,183,874 B1 * 2/2001 Yamagata et al. ..... 428/472
6,209,446 B1 * 4/2001 Kurita et al. ..... 92/224
6,262,150 B1 7/2001 Behi et al. ..... 524/27
6,346,133 B1 2/2002 Narasimhan et al. ..... 75/252
6,531,089 B1 * 3/2003 Brungs et al. ..... 419/28

* cited by examiner

*Primary Examiner*—Daniel Jenkins
(74) *Attorney, Agent, or Firm*—George O. Saile; Stephen B. Ackerman

(57) ABSTRACT

Although MIM (metal injection molding) has received widespread application, aluminum has not been widely used for MIM in the prior art because of the tough oxide layer that grows on aluminum particles, thus preventing metal—metal bonding between the particles. The present invention solves this problem by adding a small amount of material that forms a eutectic mixture with aluminum oxide, and therefore aids sintering, to reduce the oxide, thereby allowing intimate contact between aluminum surfaces. The process includes the ability to mold and then sinter the feedstock into the form of compacted items of intricate shapes, small sizes (if needed), and densities of about 95% of bulk.

28 Claims, 2 Drawing Sheets

FORMING COMPLEX-SHAPED ALUMINUM COMPONENTS

FIELD OF THE INVENTION

The invention relates to formation of objects, having net-shaped and other complex geometries, from aluminum and its alloys with particular reference to powder metallurgy and metal injection molding.

BACKGROUND OF INVENTION

Aluminum and its alloys are commonly used in many applications such as cooking utensils, industrial components, photographic reflectors and storage equipment. These materials have several very important desirable attributes such as light weight, high thermal conductivity, non-magnetic, high strength-to-weight ratio, which are not commonly found in other metal alloys.

For cooking utensils, its light weight, high thermal conductivity and high corrosion resistance make it very attractive for food preparation. For industrial components, its excellent corrosion resistance, high thermal conductivity and superior strength-to-weight ratio allow many important applications such as actuator arms in hard disk drive, heat sink and electronic casings. For photographic reflectors, it offers the advantages of high light reflectivity and non-tarnishing characteristics. Furthermore, the non-magnetic characteristics makes aluminum useful for electrical shielding purposes such as bus-bar housings or enclosures for other electrical equipment.

These aluminum and aluminum alloys in various applications can be processed in many different ways. For example, a shape and investment casting process can offer design flexibility with low capital investment but the method is not suitable for large volume production because a new mold is required for each cast piece. Die casting offers high volume capability and design flexibility but the finished part is prone to internal porosity, blow holes and undesirable flashing. Extrusion processes are simple but the geometry is very limited. In forging, the process offers good mechanical properties but limited shape complexity and additional secondary operations needed. Thus, all these processes are limited when applied to the production of miniaturized components in large volumes.

Another metal forming process is powder metallurgy where a metal powder is used and shaped into finished parts that meet the dimensional specifications of the finished article along with excellent shape complexity, minimal level of porosity and little or no material wastage. Powder metallurgy is well known in this field but shape complexity is restricted by the die compaction geometry and the powder flowability.

Metal Injection Molding (MIM) is another known field with many patents filed and issued over the last 20 years. However, these tend to be limited to common, less reactive, materials such as iron, stainless steels, low-alloy steels and tungsten alloys. When used in a metal injection molding process, aluminum in powder form is found to be reactive, rapidly forming surface oxide films. As a result good mechanical properties and low-impurity bodies are difficult to obtain, regardless of what sintering process is employed. These oxide films are not easily removed or reduced. For this reason, processes for producing net-shaped and complex parts via aluminum powder are limited. While powder metallurgy pressing operation may provide high green strength through sufficient pressure, metal injection molding is not known to produce metal parts from aluminum powder.

A routine search of the prior art was performed with the following references of interest being found:

U.S. Pat. No. 4,623,388 describes a process for producing a composite material. A matrix of aluminum reinforced by silicon carbide particles. The concentration of silicon carbide was much greater than concentrations used to promote sinterability (as in our invention). Other examples of aluminum-alloy composite can be found in U.S. Pat. No. 4,973,522 and in U.S. Pat. No. 6,077,327. In these processes the purpose of adding silicon carbide into aluminum is for high pressure compaction (mold temperature has to be higher than melting point of aluminum, 660° C.). This is not applicable to the present invention where mold temp is not more than 150° C. These processes seek to enhance thermal conductivities in the sintered composite. They represent a powder metallurgy process where the green part already has very high density (about 90–95%) but shape geometry is very limited. They require the addition of silicon carbide has to be substantial to see the effect.

In U.S. Pat. No. 5,057,903, the use of aluminum and silicon carbide particles is to promote thermal conductivities in thermoplastic based material, while U.S. Pat. No. 6,346,133 describes metal based powder compositions containing silicon carbide as an alloying powder. Here silicon carbide is added into iron-based or nickel based powder, under high pressure and high temperature compaction, to enhance strength, ductility, and machine-ability.

In U.S. Pat. No. 3,971,657, Daver teaches production of sintered bodies of particulate metal, especially porous sintered bodies, from particles of metal having a refractory oxide coating. A minor proportion of a flux is mixed with the particulate metal before sintering to aid in removing oxide from surfaces of the metal particles. The particulate metal may be aluminum, with which there may be mixed a minor proportion of particles of an alloying element. The flux may be a mixture of potassium fluoaluminate complexes; the residue of this flux, after sintering, provides a coating that aids in protecting the sintered article against corrosion. An important feature of the Daver process is that the product after sintering has high porosity (and low density). In fact, one application of the process is for the production of filters.

In U.S. Pat. No. 6,262,150 entitled "Feedstock and Process for Metal Injection Molding", it is reported that new binder additives can enhance solid loading for many materials including aluminum, but aluminum in powder form, as mentioned earlier, is reactive and will not exhibit good sintering behavior, particularly since exposure to water is required to remove the binder.

SUMMARY OF THE INVENTION

It has been an object of at least one embodiment of the present invention to provide a process for manufacturing aluminum, and aluminum alloy, objects of small size and intricate shapes.

Another object of at least one embodiment of the present invention has been that said process be based on metal injection molding.

Still another object of at least one embodiment of the present invention has been that said process be compatible with metal injection molding as practiced for other materials.

These objects have been achieved by mixing a composition of elemental powders into a feedstock that includes aluminum in the amount of at least 95% by weight, the rest being silicon carbide or a metallic fluoride in an amount sufficient for the required density and strength. The process includes molding the feedstock into the form of compacted items such as heat sink and then sintering the compact items at sintering temperature of between 600° C. and 650° C.

The sintering temperature of the alloy is between 600° C. to 650° C. in either vacuum or nitrogen or argon atmosphere. In the desired alloy, it comprises approximately 97% by weight of Al, and the rest 3% by weight of silicon carbide or metallic fluorides with a sintering temperature of between 600° C. and 650° C. and a sintering time of approximately 60 minutes in a vacuum atmosphere of <0.01 torr.

The technical advantage of the aluminum alloy of the present invention is that it is relatively easy to source for the alloys. Aluminum, Silicon Carbide and metallic fluorides are easy to buy from powder manufacturers worldwide.

The aluminum alloys of the present invention can be easily manufactured in large volume economically in many intricate shapes and sizes.

Another technical advantage of the present invention is that it can be net-shaped with excellent dimensional control and mechanical properties. Little or no secondary operation is necessary to the finished parts. Further, the present invention allows the manufacture of miniaturized complex geometry of less than 1 g, wall thickness of less than 0.3 mm and surface finish of less than 0.5 microns.

DESCRIPTION OF THE PREFERRED EMBODIMENTS

Figure 1:
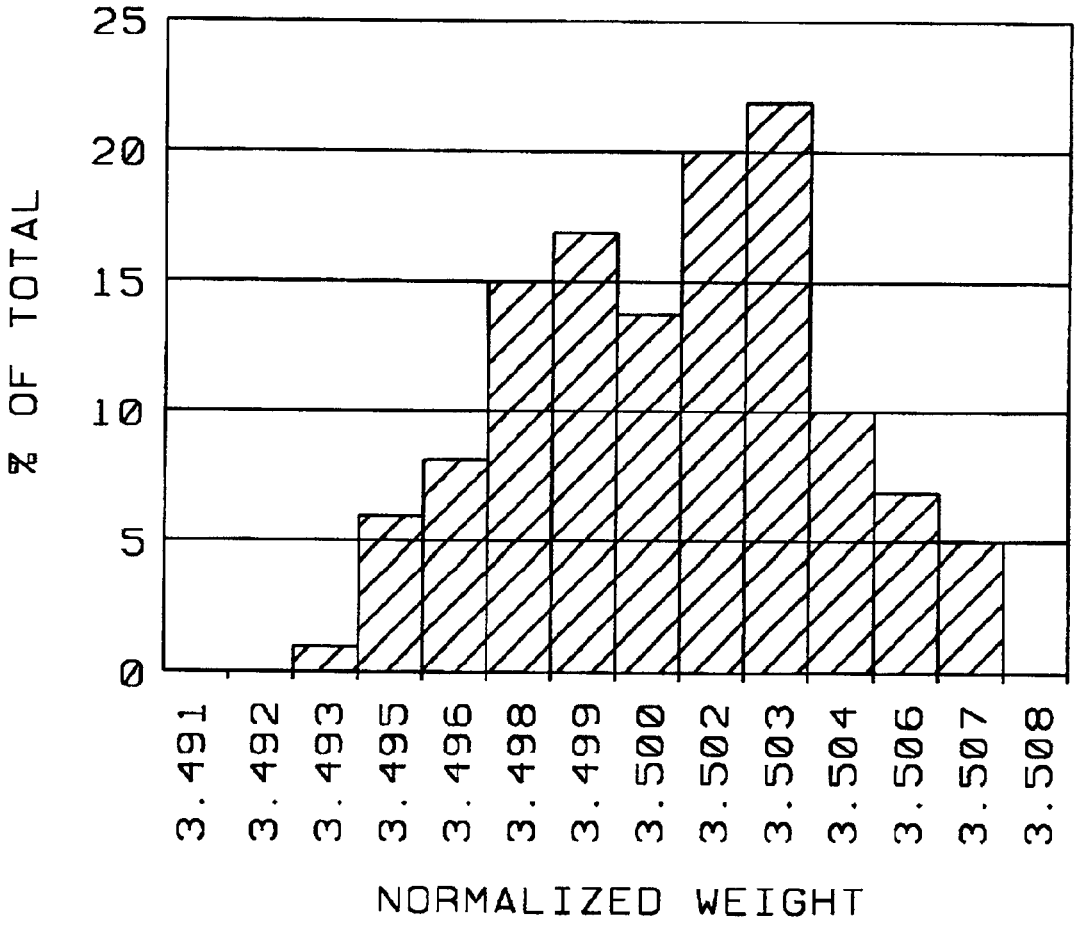
FIG. 1 is a histogram plotting number of samples against thickness.

As already noted, aluminum has not been widely used for MIM in the prior art because of the tough oxide layer that grows on aluminum particles, thus preventing metal—metal bonding between the particles. The present invention teaches that the addition of a small amount of material that aids sintering (by forming a eutectic mixture with aluminum oxide) dissolves the latter thereby allowing intimate contact between aluminum surfaces.

The concentration of the aluminum or aluminum alloy (defined as aluminum and up to 10 total percent by weight of one or more metals selected from the group consisting of Fe, Si, Mn, Mg, Cu, Zn, Ni, Pb, Sn, and Ti) relative to the added sintering aiding material should be 95–99% by weight. The selection and control of the metal particle sizes in the powder is an important aspect of the present invention. The metal powder size and powder size distribution used to produce the sintered articles do have an effect on the properties of the ultimate products obtained. Therefore, the metal powder size and powder size distribution used in the present invention are selected so as to impart maximum density and other desired properties to the alloys produced. As a key feature of the present invention, it teaches that the ratio (aluminum particle size):(additive particle size) should not exceed 3:13, with 3:5 being preferred. Additionally, concentration by weight of both aluminum and the additive are in inverse proportion to their average particle sizes. Thus, for example, if the average aluminum particle size is doubled, then the weight concentration of aluminum particles must be cut in half.

Preferably, the aluminum powder should have a mean particle size of about 1 to 15 microns and additives like silicon carbide or metallic fluorides have a mean particle size of 1 to 50 microns. Only a small percentage of the mix needs to be the sintering aiding element since the eutectic liquid will be gradually squeezed out from between aluminum particles as they bond to one another, ending, eventually at the surface. If the additive particles are too large, there will be too few of them distributed throughout the mix. If the weight fraction of additive material is too large, the excess additives will not go through the reaction, remaining in their original state with its associated high melting temperature. They will not sinter, resulting in unsintered local structures.

The aluminum, silicon carbide and metallic fluoride powders are available commercially in the required particle size ranges. The metal powder having the above composition is then mixed with a plasticizer (also known as a binder) to form a feedstock which can be compacted using heavy tonnage presses and injection molded using conventional injection molding machines. As well known to those skilled in the art, organic polymeric binders are typically included in the molded articles for the purpose of holding them together until they are debinded prior to the sintering process. An organic polymeric binder is preferred over the water-based binders or water soluble polymers since water may react with the reactive aluminum powder and accelerate the formation of the surface oxide film.

Essentially any organic material will function if it will decompose under elevated temperatures without leaving an undesired residue that will be detrimental to the properties of the metal articles can be used in the present invention. Preferred materials are various organic polymers such as stearic acids, micropulvar wax, paraffin wax and polyethylene.

The feedstocks are then either compacted or injection molded. In particular, the metal powder can be injection molded using conventional injection molding machines to form green articles. The dimensions of the green articles are determined by the size of the tooling used, which in turn is determined by the dimensions of the desired finished articles, taking into account the shrinkage of the articles during the sintering process. Similarly, the metal powder can be pressed with either high tonnage hydraulic or mechanical press in a die to form a green part.

After the feedstock has been compacted or injection molded into the desired shape, which can be complex in geometry, the binder is removed by any one of a number of well known debinding techniques available to the metal injection molding industry such as, but not limited to, solvent extraction, thermal, catalytic or wicking.

Subsequently, the molded or formed articles from which the binder has been removed are densified in a sintering step in any one of a number of furnace types such as, but not limited to, batch vacuum, continuous atmosphere or batch atmosphere. Preferably, the sintering process is carried out in batch vacuum furnace as it is efficient and economical.

The selection of supporting plates used for the sintering process is important. It is desirable that a material which does not decompose or react under sintering conditions, such as alumina, be used as a supporting plate for the articles in the furnace. Contamination of the metal alloys can occur if suitable plates are not used. For example, a graphite plate is not usable as it may react with the aluminum alloys used in the present invention.

Sintering is carried out with sufficient time and temperature to cause the green article to be transformed into a sintered product, i.e. a product having density of at least 95% of theoretical, preferably at least 99% of theoretical.

Sintering processes suitable for producing aluminum alloys require special attentions to prevent common defects such as warpage, cracking, and non-uniform shrinkage by the articles. Sintering can be carried out in either vacuum or nitrogen or argon atmosphere, preferably a vacuum of less than 0.01 torr or gases with relative humidity and oxygen content less than 0.6%. The temperature is ramped up gradually from room temperature to the sintering temperature at a ramp rate of 25° C./hr to 45° C./hr. Typically the temperature is between 600° C. to 650° C. for 30 to 90 minutes. A good vacuum of less than 1 torr at sintering temperature will provide excellent temperature uniformity in the furnace which in turn brings about even and uniform shrinkage of the articles in batch size.

Care must be taken during sintering. Too rapid a temperature ramping rate and insufficient sintering temperature and time will result in the production of aluminum alloys which have poor properties in term of density, strength, inconsistent shrinkage, fragility and the like.

An example of a sintering profile which has been found to be particularly effective for manufacture of aluminum steel efficiently and economically in accordance with the present invention involves heating the green articles in vacuum of less than 0.01 torr from room temperature to 300° C. in 30° C./hr and maintain at that temperature for about 0.5–1.0 hr. The ramp rate is then increased to 50° C./hr until the temperature reaches the sintering temperature of 600° C.–650° C., maintaining for 30–120 minutes. The temperature is then either cooled gradually or rapidly cooled using inert gases such as argon or nitrogen by the cooling fan of the furnace.

The physical dimensions and weight of the sintered aluminum alloys are consistent from batch to batch. The variability of dimensions and weights within the same batch is minimal. Close tolerances of dimensions and weight can be achieved and thus eliminates the need for secondary machining processes which can be costly and difficult.

After the sintering process has been completed, aluminum alloy parts manufactured according to the teachings of the present invention can be removed from the sintering furnace and used as is or it can be subjected to well-known conventional secondary operations such as a glass beading process to clean the sintered surface and tumbling to smooth off sharp edges.

The aluminum alloys produced in the present invention can be used in a variety of different industrial applications in the same way as prior art aluminum alloys, their most valuable applications being in areas where high complexity or miniaturization are required.

The sintered aluminum of the present invention can be easily and rapidly produced over a large range of intricate shapes and profiles. Variability in weight and physical dimension between successful parts is very small, which means that post sintering machining and other mechanical working can be totally eliminated.

EXAMPLES

In a double-V blender machine, 68,670 g of aluminum powder having a mean particle size of 8 microns, 2,130 g of silicon carbide powder, having a mean particle size of 40 microns and 460 g of stearic acids were blended for 4 hours. After a homogeneous mixture had been obtained, the mixture was transferred to a mixing machine.

The mixing machine is a double-planetary mixer where the bowl was heated to 150° C. using circulating oil in the double-walled bowl. The well blended powder mixture was placed inside the bowl with the organic binders of 3,230 g of micropulvar wax, 3,230 g of semi-refined paraffin wax and 2,310 g of polyethylene alathon.

The mixture of powder and organic binders took 4.5 hours to form a homogeneous powder/binder mixture with the final hour being in vacuo. The powder/binder mixture was then removed from the mixing bowl and cooled in open air. Once it was cooled and solidified at room temperature, it was granulated to form a granulated feedstock. The density of the granulated feedstock was measured by a helium gas pycnometer and found to be identical to the theoretical density.

An injection-molding machine was fitted with a mold for a rectangular block. The sintered block has a total length of 25.0×15.0×3.5 mm. Based on the expected linear sintering shrinkage of 10%, the mold is 10% larger in all dimensions than the rectangular block. The injection-molding composition was melted at a composition temperature of 190° C. and injected into the mold which was at 100° C. After a cooling time of about 20 seconds, the green parts were taken from the mold.

The green rectangular block was laid on an alumina oxide supporting plate and was heated to 300° C. at a rate of 30° C./hr, held for an hour before heating to 640° C. at a rate of 50° C./hr., held for an hour, under a vacuum of less than 0.01 torr in a sintering furnace. The sintering time was 60 minutes at 640° C. and the sintering furnace was then cooled. This gave a rectangular block having exactly the correct dimensions.

A sample of 125 pcs of rectangular block was taken to measure the weight and its thickness and a histogram to show the distributions was plotted. The results as seen in FIG. 1, show that the Cp ((USL-LSL)/6$\sigma$ where USL is upper specification limit and and LSL is lower specification limit) at 3 sigma distribution of the thickness dimension is 1.58. The process using vacuum sintering produced aluminum alloys with excellent process control in term of dimension. When a linear tolerance of 0.5% is applied to the thickness dimension, the specification of thickness would be 3.50±0.015 mm. The Cpk ((USL-$\mu$} where $\mu$ is the mean) would be 1.55. The surface finish is Ra (roughness value) of 0.8 to 1.6 microns.

Figure 2:
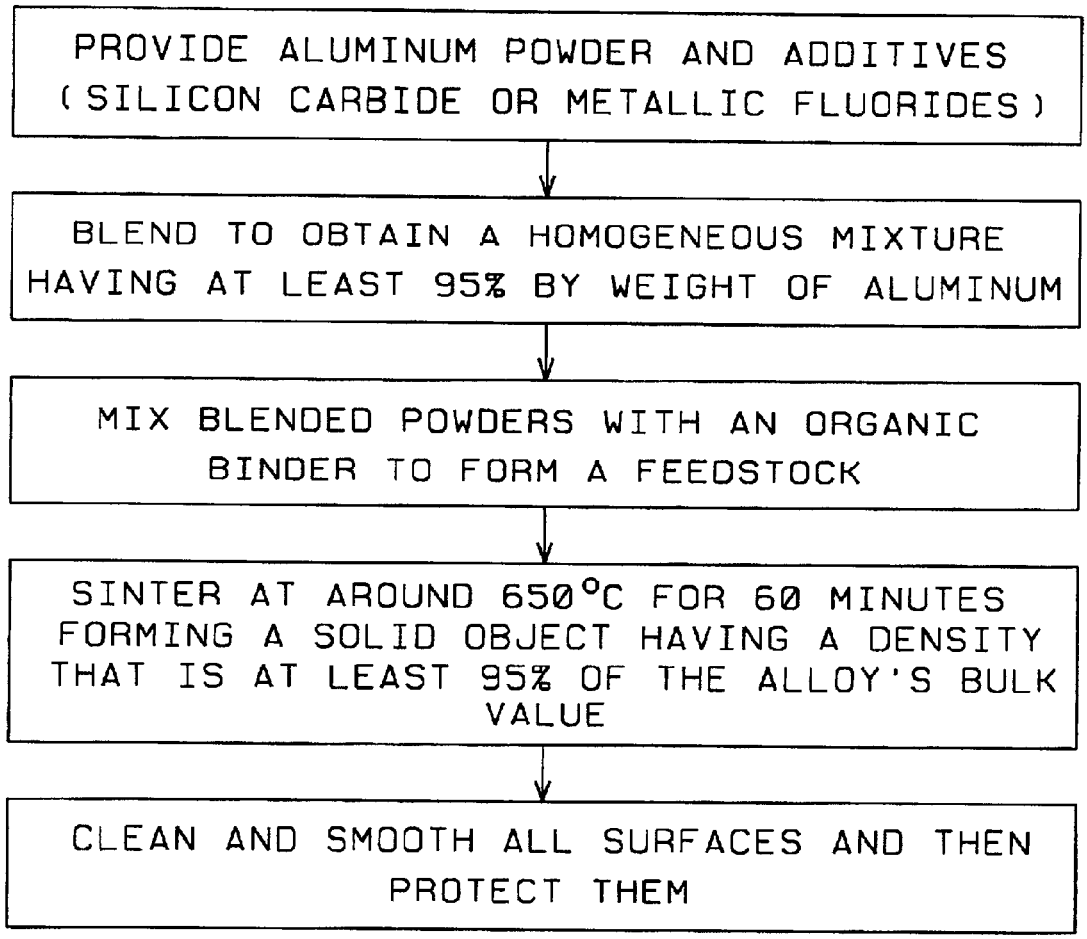
FIG. 2 is a flow diagram of the process of the present invention.

A diagram illustrating the process flow of the present invention is shown in FIG. 2.

What is claimed is:

1. A process to manufacture an aluminum object having a complex shape, comprising:

providing a first powder of aluminum particles having a first average size;

providing a second powder of additive particles, known to form a eutectic mixture with aluminum oxide, having a second average size;

forming a eutectic mixture by mixing said powders together in a relative concentration by weight and then adding a binder material, thereby forming a feedstock;

injecting said feedstock into a mold thereby forming a green part;

releasing said green part from said mold and removing all of said binder, thereby forming a skeleton;

heating said skeleton at a temperature sufficient to melt said eutectic mixture, thereby facilitating sintering of said aluminum particles to form said object to a density that is at least 95% that of bulk; and wherein said relative weight concentration of each powder is in inverse proportion to its average particle size.

2. The process described in claim 1 wherein the ratio (aluminum particle size):(additive particle size) is (3–5):(7–3).

3. A process to manufacture an aluminum alloy object having a complex shape, comprising:

providing a first powder of aluminum alloy particles having a first average size;

providing a second powder of particles, of a material known to form a eutectic mixture with aluminum oxide, having a second average size;

forming a eutectic mixture by mixing said powders together in a relative concentration by weight and then adding a binder, thereby forming a feedstock;

injecting said feedstock into a mold thereby forming a green part;

releasing said green part from said mold and removing all of said binder, thereby forming a skeleton;

heating said skeleton at a temperature sufficient to melt said eutectic mixture, thereby facilitating sintering of said aluminum alloy particles to form said object to a density that is at least 95% that of bulk; and wherein said relative weight concentration of each powder is in inverse proportion to its average particle size.

4. The process described in claim 3 wherein the ratio (aluminum alloy particle size):(additive particle size) is (3–5):(7–13).

5. The process described in claim 3 further comprising that, if said average aluminum alloy particle size is multiplied by a given factor, then said weight concentration of aluminum alloy particles is to be divided by said factor.

6. A process to manufacture an aluminum object having a complex shape, comprising:

providing a powder of aluminum particles having a first average size;

providing a powder of silicon carbide particles having a second average size;

adding a concentration of at most 5% by weight of said silicon carbide powder to said aluminum powder, mixing said powders together, and then adding a binder thereby forming a feedstock;

injecting said feedstock into a mold thereby forming a green part;

releasing said green part from said mold and removing all of said binder, thereby forming a skeleton; and then heating said skeleton, at a temperature of about 300° C. for about one hour followed by heating at about 640° C. for about one hour, both heat treatments being performed under a vacuum of less than 0.01 torr, whereby said silicon carbide particles facilitate sintering of said aluminum particles thereby forming said object to a density that is at least 95% that of bulk.

7. The process described in claim 6 wherein said binder is an organic polymer.

8. The process described in claim 6 wherein the step of removing all of said binder from said green part is selected from the group of sub-processes consisting of solvent extraction, thermal treatment, catalytic extraction, and wicking.

9. The process described in claim 6 wherein the ratio (aluminum average particle size):(silicon carbide average particle size) is (3–5):(7–13).

10. The process described in claim 9 wherein said weight concentration of silicon carbide is proportional to the ratio of said second average size to said first average size.

11. A process to manufacture an aluminum object having a complex shape, comprising:

providing a powder of aluminum particles having a first average size;

providing a powder of metallic fluoride particles having a second average size;

adding at most 5% by weight of said metallic fluoride powder to said aluminum powder, mixing said powders together, and then adding a binder, thereby forming a feedstock;

injecting said feedstock into a mold thereby forming a green part;

releasing said green part from said mold and removing all of said binder, thereby forming a skeleton; and then heating said skeleton for a period of time whereby said metallic fluoride particles facilitate sintering of said aluminum particles thereby forming said object to a density that is at least 95% that of bulk.

12. The process described in claim 11 wherein said metallic fluoride is selected from the group consisting of NaF, CaF, and MgF.

13. The process described in claim 11 wherein said binder is an organic polymer.

14. The process described in claim 11 wherein the step of removing all of said binder from said green part further is selected from the group of sub-processes consisting of solvent extraction, thermal treatment, catalytic extraction, and wicking.

15. The process described in claim 11 wherein the step of heating said skeleton further comprises heating at a temperature of about 300° C. for about one hour followed by heating at about 640° C. for about one hour, both heat treatments being performed under a vacuum of less than 0.01 torr.

16. The process described in claim 11 wherein the ratio (aluminum average particle size):(metallic fluoride average particle size) is (3–5):(7–13).

17. A process to manufacture an aluminum alloy object having a complex shape, comprising:

providing a powder of aluminum alloy particles having a first average size;

providing a powder of silicon carbide particles having a second average size;

adding a concentration of at most 5% by weight of said silicon carbide powder to said aluminum alloy powder, mixing said powders together, and then adding a binder, thereby forming a feedstock;

injecting said feedstock into a mold thereby forming a green part;

releasing said green part from said mold and removing all of said binder; thereby forming a skeleton; and then heating said skeleton, at a temperature of about 300° C. for about one hour followed by heating at about 640° C. for about one hour, both heat treatments being performed under a vacuum of less than 0.01 torr, whereby said silicon carbide particles facilitate sintering of said aluminum alloy particles thereby forming said object to a density that is at least 95% that of bulk.

18. The process described in claim 17 wherein said aluminum alloy further comprises aluminum and up to 10 total percent by weight of one or more metals selected from the group consisting of Fe, Si, Mn, Mg, Cu, Zn, Ni, Pb, Sn, and Ti.

19. The presses described in claim 17 wherein the step of removing all of said binder from said green part is selected from the group of sub-processes consisting of solvent extraction, thermal treatment, catalytic extraction, and wicking.

20. The process described in claim 17 wherein the ratio (aluminum alloy average particle size):(silicon carbide average particle size) is (3–5):(7–13).

21. The process described in claim 20 wherein said weight concentration of silicon carbide is proportional to the ratio of said second average size to said first average size.

22. A process to manufacture an aluminum alloy object having a complex shape, comprising:

providing a powder of aluminum alloy particles;

providing a powder of metallic fluoride particles;

adding at most 5% by weight of said metallic fluoride powder to said aluminum alloy powder, mixing said powders together, and then adding a binder, thereby forming a feedstock;

injecting said feedstock into a mold thereby forming a green part;

releasing said green part from said mold and removing all of said binder, thereby forming a skeleton; and then heating said skeleton for a period of time whereby said metallic fluoride particles facilitate sintering of said aluminum alloy particles thereby forming said object to a density that is at least 95% that of bulk.

23. The process described in claim 22 wherein said aluminum alloy further comprises aluminum and up to 10 total percent by weight of one or more metals selected from the group consisting of Fe, Si, Mn, Mg, Cu, Zn, Ni, Pb, Sn, and Ti.

24. The process described in claim 22 wherein said metallic fluoride is selected from the group consisting of NaF, CaF, and MgF.

25. The process described in claim 22 wherein said binder is an organic polymer.

26. The process described in claim 22 wherein the step of removing all of said binder from said green part is selected from the group of sub-processes consisting of solvent extraction, thermal treatment, catalytic extraction, and wicking.

27. The process described in claim 22 wherein the step of heating said skeleton further comprises heating at a temperature of about 300° C. for about one hour followed by heating at about 640° C. for about one hour, both heat treatments being performed under a vacuum of less than 0.01 torr.

28. The process described in claim 22 wherein the ratio (aluminum alloy average particle size):(metallic fluoride average particle size) is (3–5):(7–13).

* * * * *